US012037859B2

(12) United States Patent
Shuttleton

(10) Patent No.: US 12,037,859 B2
(45) Date of Patent: Jul. 16, 2024

(54) DEVICE AND APPARATUS

(71) Applicant: ENOVATE SYSTEMS LTD, Aberdeen (GB)

(72) Inventor: Anthony Shuttleton, Aberdeenshire (GB)

(73) Assignee: ENOVATE SYSTEMS LTD., Aberdeen (GB)

( * ) Notice: Subject to any disclaimer, the term of this patent is extended or adjusted under 35 U.S.C. 154(b) by 0 days.

(21) Appl. No.: 17/797,387

(22) PCT Filed: Jan. 21, 2021

(86) PCT No.: PCT/GB2021/050133

§ 371 (c)(1),
(2) Date: Aug. 3, 2022

(87) PCT Pub. No.: WO2021/156601

PCT Pub. Date: Aug. 12, 2021

(65) Prior Publication Data

US 2023/0052359 A1 Feb. 16, 2023

(30) Foreign Application Priority Data

Feb. 3, 2020 (GB) ..... 2001448

(51) Int. Cl.
*E21B 23/12* (2006.01)
*E21B 29/08* (2006.01)
*E21B 33/06* (2006.01)

(52) U.S. Cl.
CPC ..... *E21B 23/12* (2020.05); *E21B 29/08* (2013.01); *E21B 33/063* (2013.01)

(58) Field of Classification Search
CPC ..... E21B 29/08
(Continued)

(56) References Cited

U.S. PATENT DOCUMENTS 6,497,286 B1 * 12/2002 Hopper ..... E21B 43/013 166/341
6,561,276 B2 * 5/2003 Hamilton ..... E21B 33/076 166/341

(Continued)

OTHER PUBLICATIONS

International Search Report and Written Opinion dated May 7, 2021 for corresponding International Application No. PCT/GB2021/050133.

(Continued)

*Primary Examiner* — Matthew Troutman
*Assistant Examiner* — Douglas S Wood
(74) *Attorney, Agent, or Firm* — TAROLLI, SUNDHEIM, COVELL & TUMMINO L.L.P.

(57) ABSTRACT

The present disclosure provides a bore selector device (10) comprising a housing (11) defining a bore (20) extending therethrough, the bore having a main longitudinal axis. The bore selector device also comprises at least a first and a second actuator (13) opposite each other. Each of the first and second actuators being moveable between respective retracted and extended positions in a direction perpendicular to the main longitudinal axis. Each actuator is connected to a respective ram (12) such that the rams are each moveable between respective retracted positions and extended positions in a direction perpendicular to the main longitudinal axis. Each actuator and attached ram is moveable in the same linear direction.

27 Claims, 12 Drawing Sheets

(58) Field of Classification Search
USPC ..... 166/339
See application file for complete search history.

(56) References Cited

U.S. PATENT DOCUMENTS

| | | | | |
|---|---|---|---|---|
| 8,881,828 | B2 * | 11/2014 | Strand | E21B 33/038 166/344 |
| 9,234,393 | B2 * | 1/2016 | Edwards | E21B 17/18 |
| 2015/0176353 | A1 * | 6/2015 | Edwards | E21B 17/18 166/339 |
| 2017/0067310 | A1 * | 3/2017 | Nilsen | E21B 33/063 |
| 2018/0283128 | A1 | 10/2018 | Trivedi | |
| 2019/0145214 | A1 * | 5/2019 | Rao | E21B 29/08 166/55 |

OTHER PUBLICATIONS

"Enovate: Enbalance 5 Bore Selector", (Oct. 12, 2019), XP002802230, retrieved from the internet: http://www.enovate.com/product/bore-selector-enbalance-5/ retrieved on Mar. 2, 2021.
Combined Search and Examination Report dated Jul. 16, 2020, for corresponding GB Application No. 2001448.6.
Wikipedia page, "Blowout preventer" at: http://en.wikipedia.org/wiki/Blowout_preventer#/Ram_blowout_preventer retrieved on Jul. 15, 2020.
Office Action dated Jul. 6, 2023 issued on corresponding Chinese application 2021800125804. English translation not provided.

* cited by examiner

DEVICE AND APPARATUS

RELATED APPLICATIONS

The present application is a U.S. National Stage application under 35 USC 371 of PCT Application Serial No. PCT/GB2021/050133, filed on 21 Jan. 2021, which claims priority from GB Patent Application No. 2001448.6, filed 3 Feb. 2020, the entirety of both of which are incorporated herein by reference.

DEVICE AND APPARATUS

This invention relates, in particular, to a bore selector device and apparatus to direct tools into different bores in the well.

Access to a multi-bore bore subsea well often requires the use of a multi-bore riser extending from the well to the surface facility. Multi-bore risers add more expense to such a well installation.

An alternative is therefore to use a monobore subsea riser. To direct lowered tools into different bores of a well, devices were conventionally taken back to surface, reconfigured and re-run (round-tripped), which is a time consuming activity.

An improved option to avoid round-tripping the system is to provide a bore selector to direct access to the different bores in a multi-bore subsea well. For example, a bore selector can allow access to a production bore or an annulus bore. The bore selector enables access to the multiple bores whilst the equipment remains subsea.

However, the inventors of the present invention have noted that a limitation of existing bore selector technology is the need for specifically designed bore selectors to match the specific bore size and configuration of global subsea production systems. Due to the variety of bore sizes and configurations, bore selectors become system specific, thus limiting the number of opportunities to utilise the same bore selector.

US2015176353A discloses a ram type bore selector arrangement that uses a linkage mechanism to translate vertical piston movement to horizontal ram movement to elect the chosen bore and whilst generally satisfactory the inventors of the present invention have made improvements to mitigate some limitations of the art. For example, in a closed position, the present inventors have noted that the linkage mechanism can be susceptible to damage from tool string/dropped object impact to the rams, which may affect functionality.

In accordance with a first aspect of the present invention there is provided a bore selector device comprising:

- a housing defining a bore extending therethrough the bore having a main longitudinal axis;
- at least a first and a second actuator each moveable between respective retracted and extended positions in a direction perpendicular to the main longitudinal axis;

each actuator connected to a respective ram such that the rams are moveable between a retracted position and an extended position in a direction perpendicular to the main longitudinal axis;

wherein each actuator and attached ram is moveable in the same linear direction.

Each ram may comprise a primary ram portion and a secondary ram portion, normally connected to the primary ram portion, the secondary portions extending from the respective primary portions generally towards the opposite actuator. At least one secondary portion may be a tongue. A groove may be provided in at least one of the primary portions, into which the tongue of the opposite ram engages when in the extended position.

The rams are normally shaped to direct items run into the well into one of two or more different directions.

In some embodiments, the primary and secondary ram portions may be formed as separate components, normally coupled together. In other embodiments, the primary and secondary ram portions may be formed as a single piece.

At least one primary ram portion can comprise a portion sloping in a first downwards direction. In the extended position, the primary ram portions may abut. They may together form a larger portion sloping in the first downwards direction, such as a funnel.

In use, the first downwards direction is usually towards an annulus bore of a well.

At least one secondary ram portion can comprise a portion sloping in a second, different, downwards direction. In the retracted position, at least one secondary portion may be positioned in the bore.

In use, the second downwards direction may be towards a production bore of a well.

At least one primary portion may define a through-passage at the first downwards direction. At least one secondary portion may define a through-passage towards the first downwards direction. Where only one primary and secondary portion define said through-passage, the defined passages are usually provided on opposite rams.

In the extended position, the through-passage of the primary and secondary portions normally align, thus maintaining a through passage.

For certain wells, there may be multiple production bores such as two or three or more.

There may be more than two actuators and respective rams.

Embodiments of the present invention can be used to direct tools to any of the multiple bores. Especially useful embodiments for such applications include actuators which are independently moveable. Thus one ram can be moved to the extended position, and the other ram positioned in the retracted position. This position allows the secondary portion of the retracted ram to obstruct the first downwards direction (usually towards the annulus bore), and the primary portion of the extended ram to obstruct another direction leading to one of the production bores leaving the other production bore(s) accessible. In embodiments comprising a first production bore and a second production bore, swapping said two ram positions will usually lead to the first production bore being accessible and the second production bore obstructed.

'Downwardly' is relative to the normal in-use orientation of the bore selector device. The main longitudinal axis of the bore is typically a vertical axis when in the in-use orientation.

The rams could be operated hydraulically, electrically or manually by, for example, an external ROV.

The actuation mechanism may be pressure balanced, meaning that should control of the device be lost, the device will fail in the position at the time of failure. In alternative embodiments, the actuation mechanism is configured with a spring type arrangement to fail-safe to a pre-defined actuator position.

The bore selector device may be less than 2 m in height, or less than 1.5 m or less than 1 m in height.

The outside diameter of the bore selector is preferably less than 2 m, or less than 1.5 m, or less than 1.3 m, and preferably less than the rotary table diameter in use. This maximises operational running and retrieval options.

The bore selector device can be utilised as part of a well intervention or plug and abandonment (P&A) system to enable access to a multi-bore well from a mono-bore riser.

Thus, the bore selector device may be used for connecting a mono-bore riser to a multi-bore subsea equipment.

At least one downwardly sloping channel may be provided in the housing below the ram the retracted position and leading to the bore therebelow. This can allow for egress of debris as the rams are retracted and can mitigate problems with debris packing off or otherwise impeding the movement of the rams and/or actuators.

The rams may also include a shearing blade or shaped with an integrated shearing edge. Such embodiments can be used for both bore selection and shearing functionality.

Preferably the bore selector device does not comprise a tool string crossover. Rather, it may comprise a connector for connecting it to a tool string crossover. Depending on the system configuration and tool strings to be run, a tool-string crossover may not be necessary. For example, a riser bore of sufficient diameter may extend in a generally vertical direction from above the bore selector to allow deployed tools to be manoeuvred into place by the bore selector device, without the need for an additional crossover.

Similarly, the bore selector device may not comprise a bore spacer sub integral with the housing, or a multiple-bore crossover. A connector is therefore normally provided to connect the bore selector device to a bore spacer sub in use. Thus, preferably the housing of the bore selector device defines a single bore beneath the rams between the rams and a connector, preferably a maximum of a single bore. The single bore may be at least 7 inches (17.8 cm in diameter) and optionally at least 9 inches (22.9 cm).

The connectors may be flange connectors.

According to a second aspect of the present invention, there is provided a bore selector apparatus comprising the bore selector device as described herein connected to at least one of an attachment and a bore spacer sub.

Optional features of the first aspect are, independently, optional features of the second aspect, and not repeated here for brevity.

The bore spacer sub usually has discrete bores, such as two, three or more. The discrete bores in use are aligned with different bores in a well, such as a production and an annulus bore and aligned with the direction the rams direct tools.

The bore-spacer sub may include a projection which extends into the bore of the bore selector device when connected thereto, normally having the discrete bores. An insert may also be provided between the projection and the rams. The insert may also include the discrete bores.

One of the discrete bores may be, for example, 1-3" in diameter; one may be 4-6" in diameter.

The bore-spacer sub may include a circulation loop.

The attachment is usually a tool string crossover or may be for example a riser. Both the attachment and bore-spacer sub may be connected to the bore selector device, 'above' and 'below' respectively.

The single bore beneath the rams of the bore selector device is normally the same diameter, or greater, than the diameter of the bore above the bore selector rams, to which the upper connector is connected in use, often a cross-over tool.

The bore of the housing is usually aligned with respective bores in the connected equipment.

In preferred embodiments, the bespoke spacings and dimensions for the particular subsea infrastructure are provided by the attached tools/subs e.g. crossover or bore-selector sub, rather than the bore selector device of the present invention, which for preferred embodiments can be used for many different types of well infrastructure and is ideally universal.

Whilst generally used as a bore selector device, in alternative embodiments, the invention may be used as shearing device for other applications.

Accordingly, in a further aspect of the invention, there is provided a shearing device comprising a housing defining a bore extending therethrough the bore having a main longitudinal axis;

a first and second actuator each moveable between respective retracted and extended positions in a direction perpendicular to the main longitudinal axis;

each actuator connected to a respective ram such that the rams are moveable between a retracted position and an extended position in a direction perpendicular to the main longitudinal axis;

the rams being shear rams;

wherein each actuator and attached ram is moveable in the same linear direction.

Such embodiments can be used for shearing applications.

The shearing blades can be configured to shear within the production bore/ and or the annulus bore, and/or other bore.

Other preferred or optional features described with respect to the first aspect of the invention are preferred and optional features for the other aspects of the invention and not repeated here for brevity.

Embodiments of the invention will now be described, by way of example only, with reference to the accompanying drawings, in which:

FIG.1 is a schematic drawing showing a bore selector apparatus comprising a bore selector device, a crossover tool and two interchangeable circulating subs;

FIG. 2*a* is a perspective view of the FIG. 1 bore selector device;

FIG. 2*b* is a front sectional view of the FIG. 1 bore selector device;

FIG. 3*a* is a perspective view of rams of the FIG. 2*a*/2*b* bore selector device in an extended position;

FIG. 3*b* is a perspective view of rams of the FIG. 2*a*/2*b* bore selector device in a retracted position;

FIGS. 4*a*-4*d* are plan sectional views of the FIG. 2*a*/2*b* bore selector device showing rams in various positions in order to select different bores;

FIG. 5*a* is a front sectional view of the FIG. 1 bore selector device with rams in an extended position of FIG. 4*b;*

FIG. 5*b* is a front sectional view of the FIG. 1 bore selector device with rams in configuration of FIG. 4*c;*

FIG. 5*c* is a front sectional view of the FIG. 1 bore selector device with rams in configuration of FIG. 4*d;*

Figure 1:
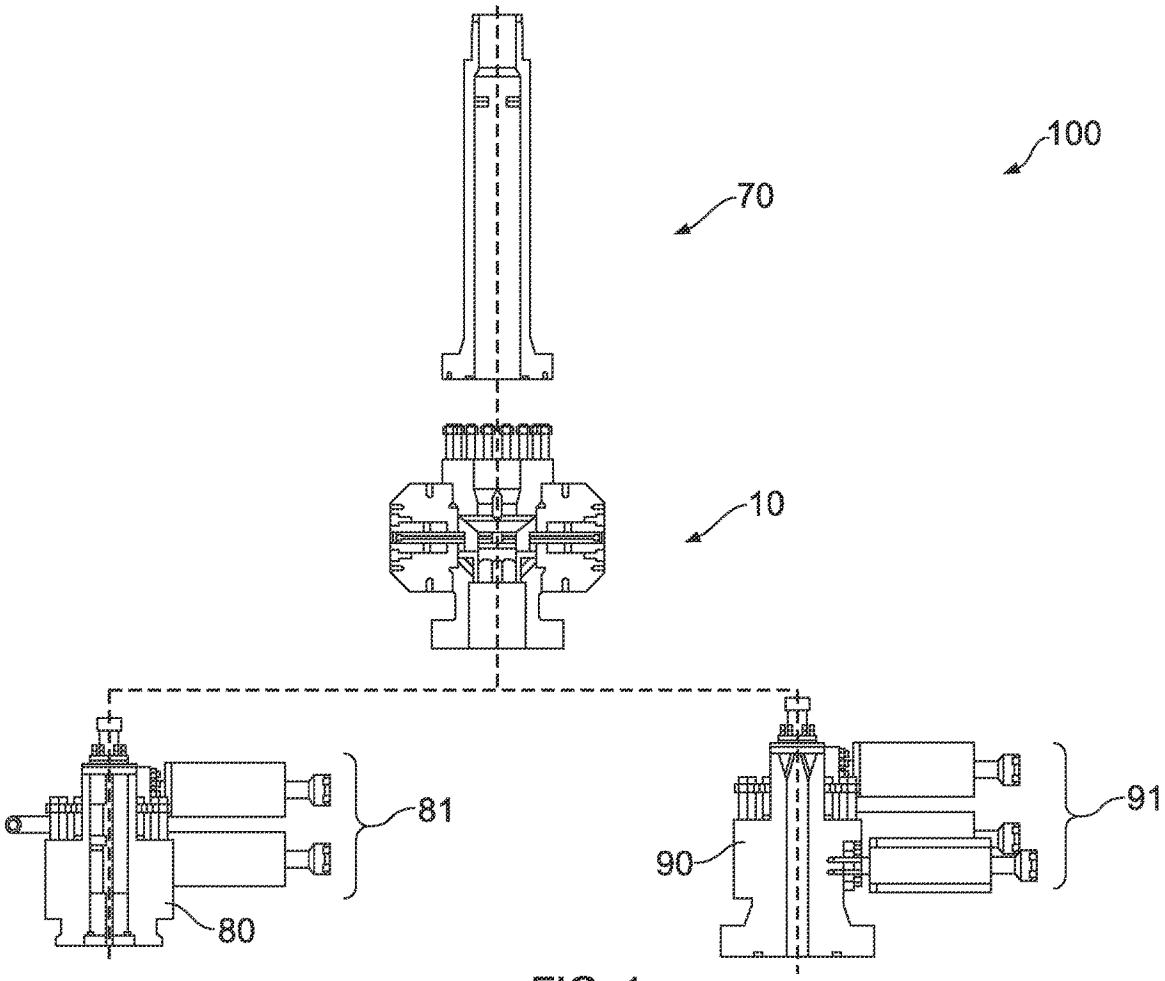
Figure 2B:
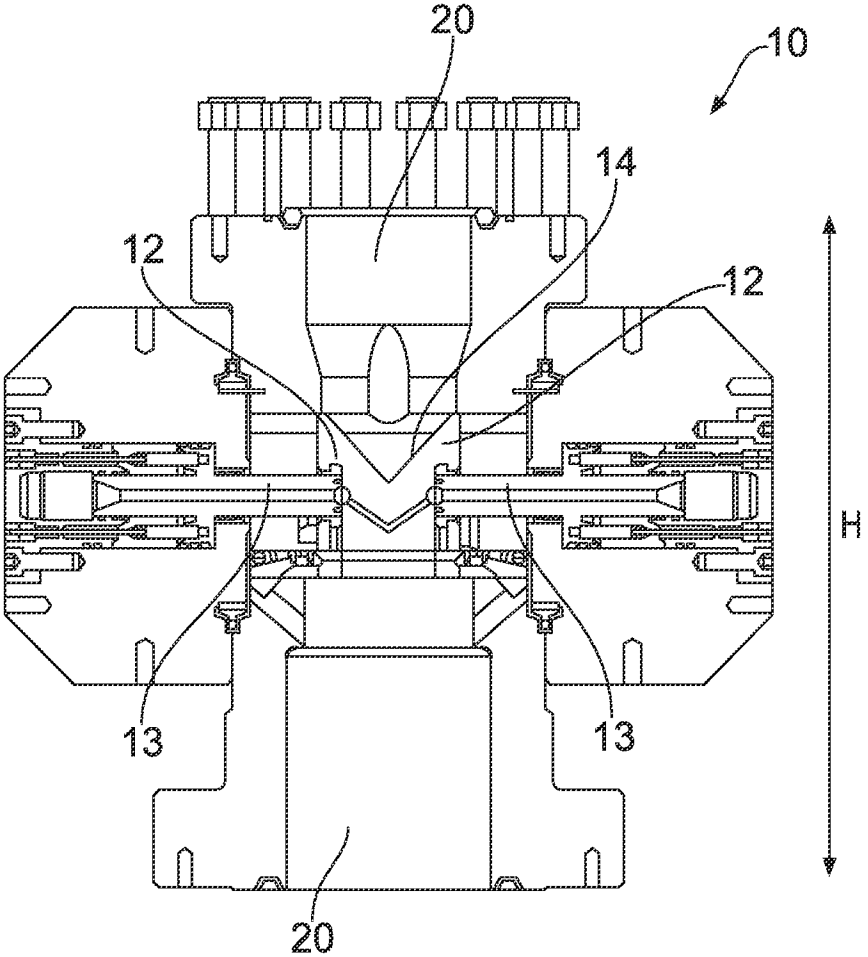
Figure 2A:
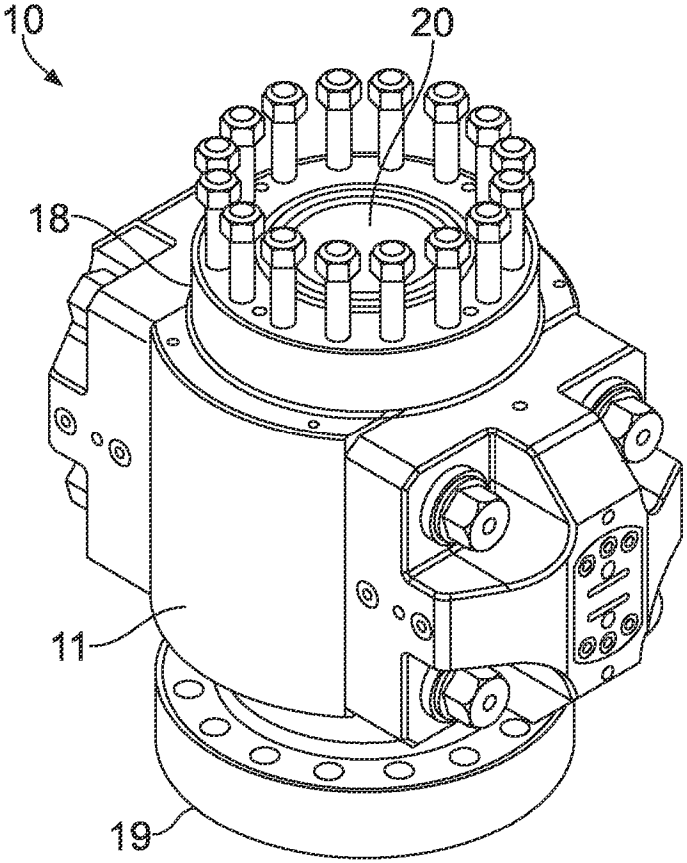
Figures 8A, 8B, 8C, 9A, 9B, 9C:
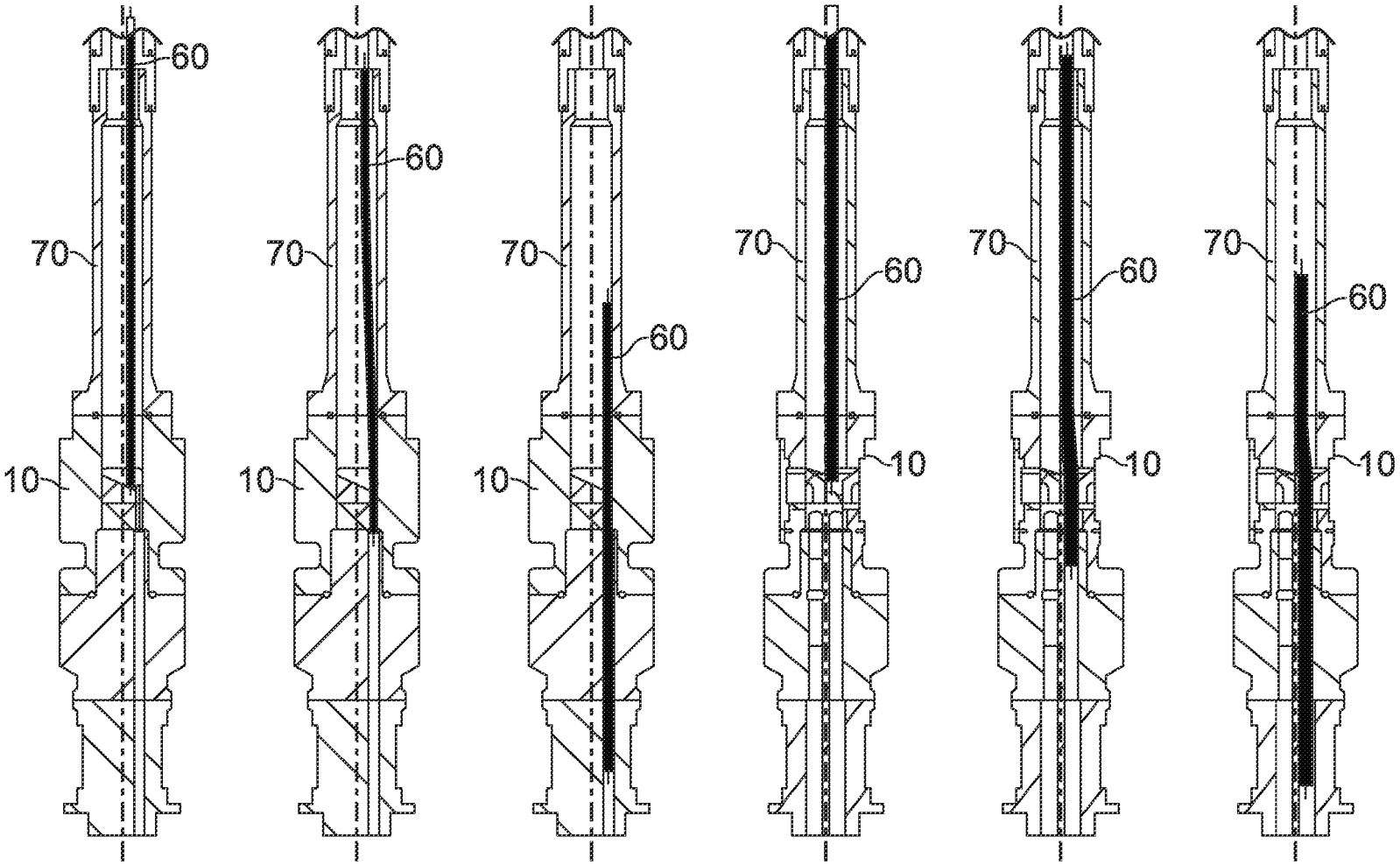
Figure 10B:
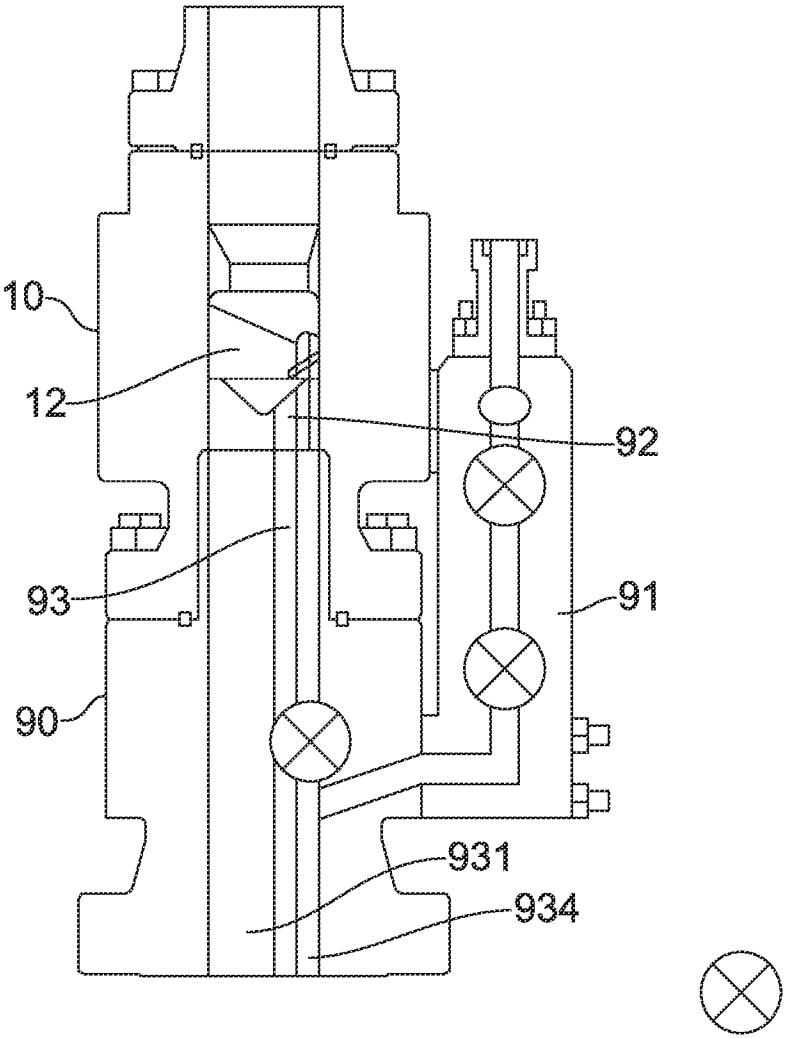
Figure 10A:
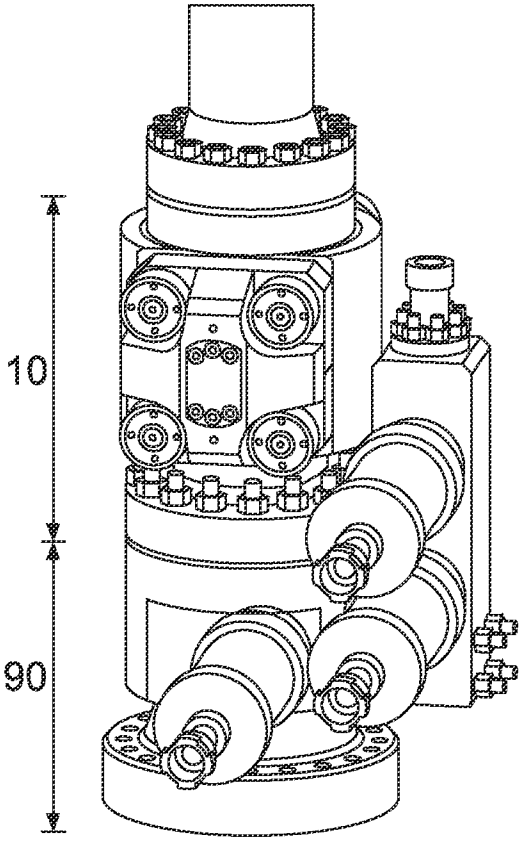
Figure 11B:
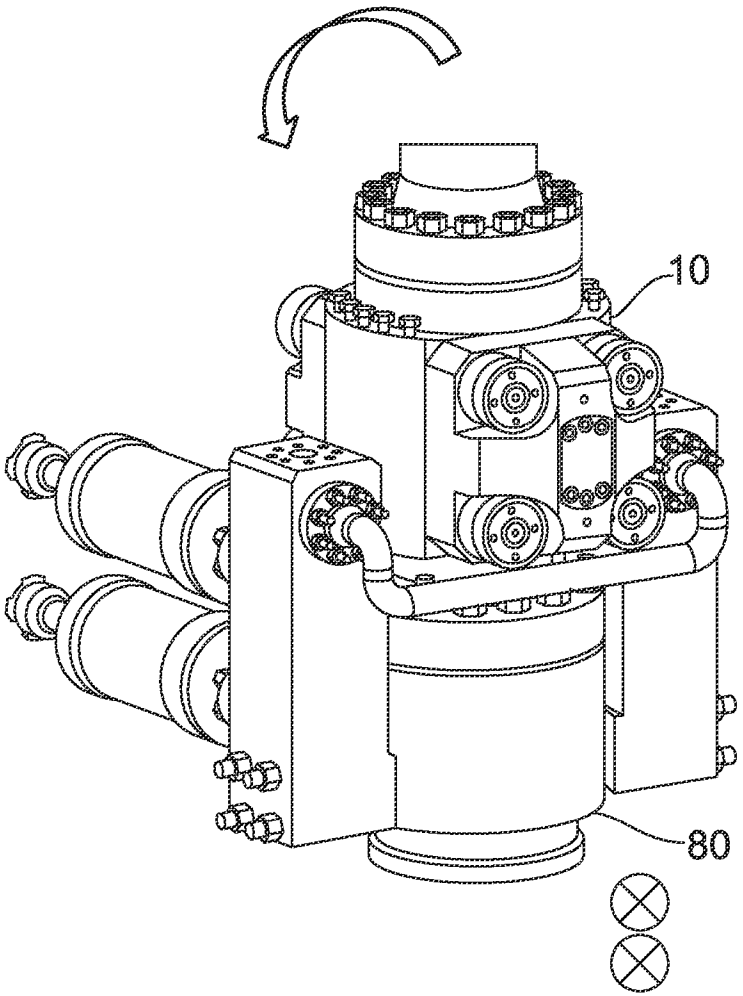
Figure 11A:
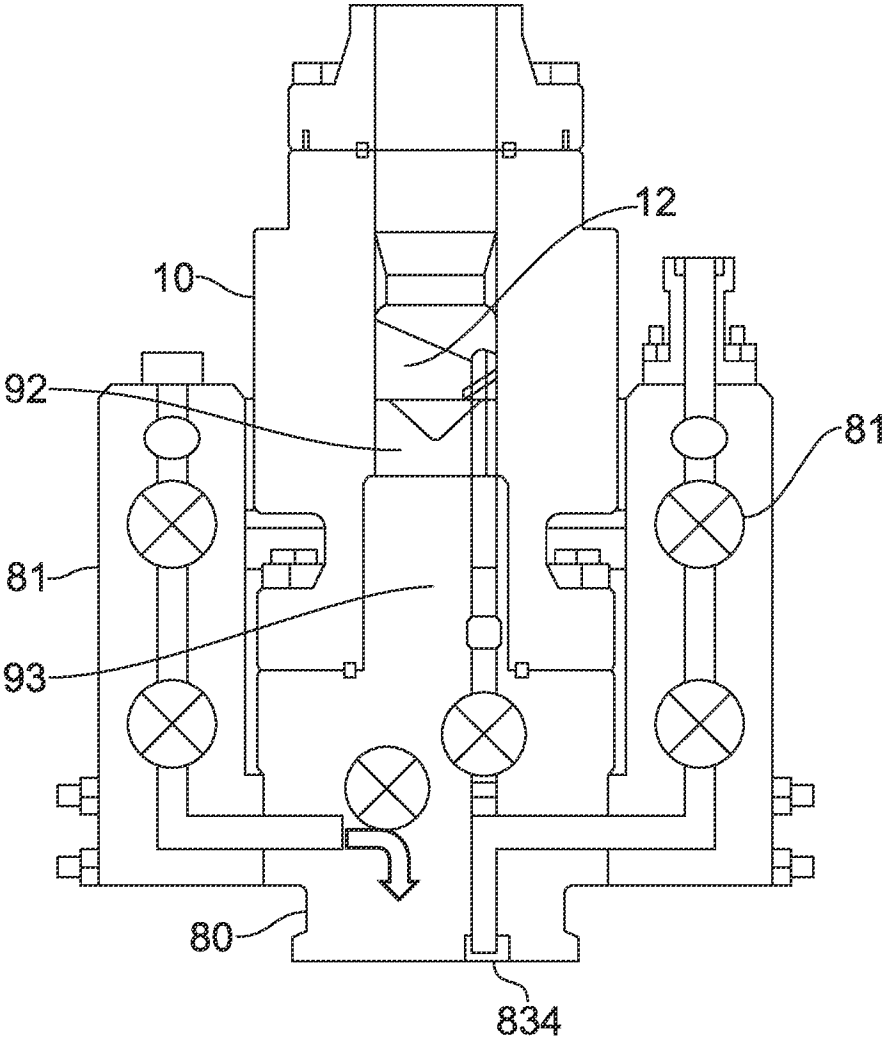
Figure 12B:
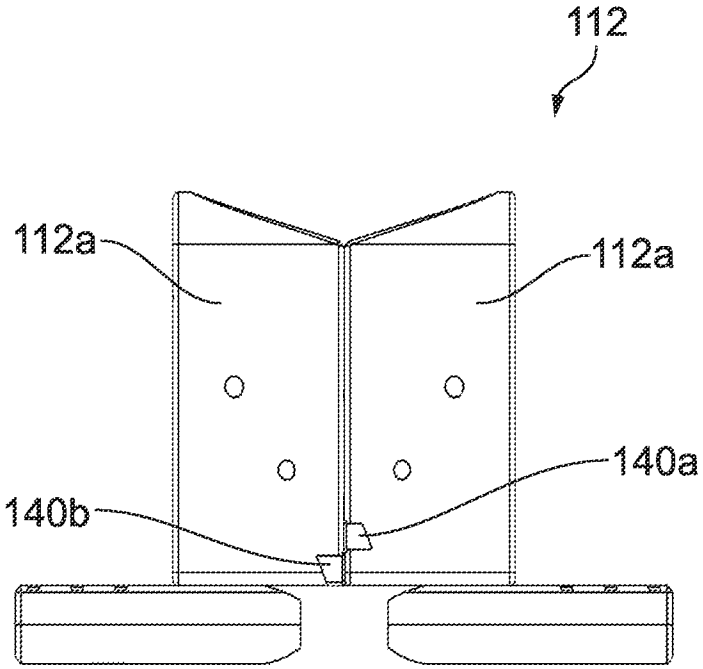
Figure 12A:
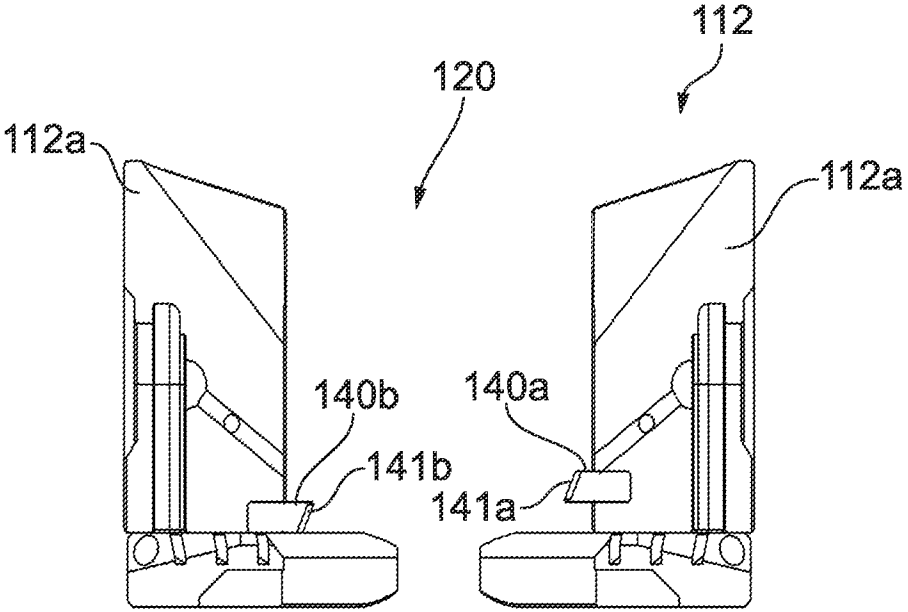
Figure 13B:
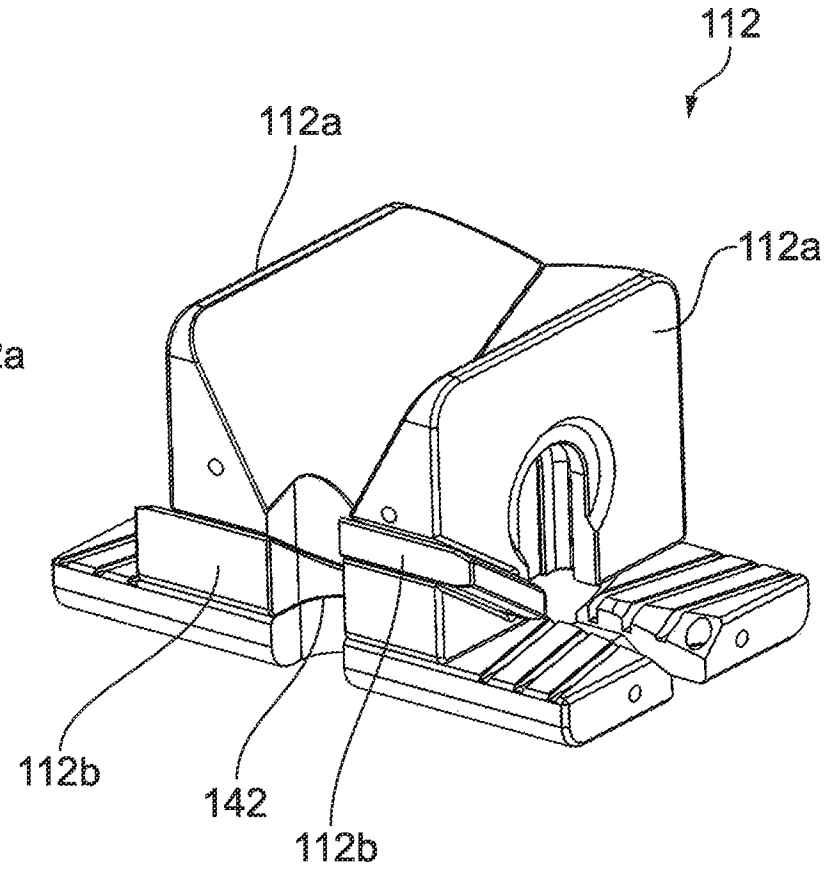
Figure 13A:
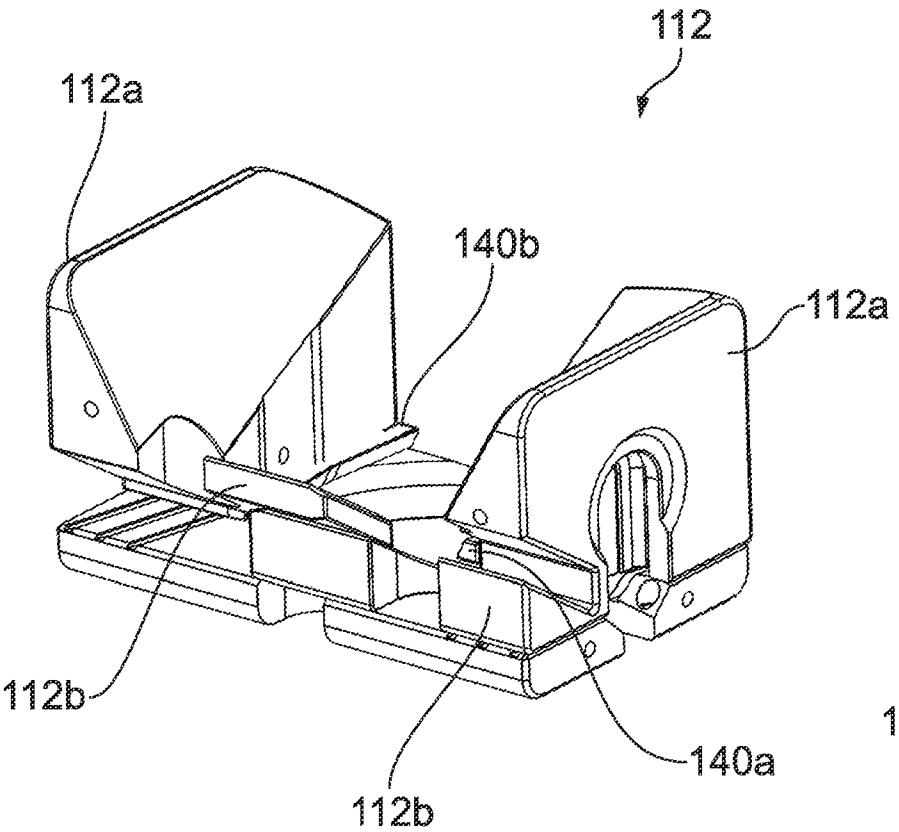

FIGS. 8*a*-8*c* are a series of sequential sectional views of the assembled bore selector apparatus of FIG. 2*a*/2*b*, showing tooling lowered and manoeuvred into an annulus bore;

FIGS. 9*a*-9*c* are a series of sequential sectional views of the assembled bore selector apparatus of FIG. 2*a*/ 2*b*, showing tooling lowered and manoeuvred into a production bore;

FIG. 10*a* is a front perspective view of the FIG. 2*a*/2*b* bore selector attached to a dual-bore circulation sub;

FIG. 10*b* is a front sectional view of the FIG. 2*a*/2*b* bore selector attached to a dual-bore circulation sub;

FIG. 11*a* is a front sectional view of the FIG. 2*a*/2*b* bore selector attached to a triple-bore circulation sub;

FIG. 11*b* is a front perspective view of the FIG. 2*a*/2*b* bore selector attached to a triple-bore circulation sub;

FIG. 12*a* is s front sectional view of the rams of the FIG. 1 bore selector device, in a retracted position, according to a further embodiment;

FIG. 12*b* is a rear sectional view of the FIG. 12*a* rams in an extended position;

FIG. 13*a* is a front perspective view of the rams of the FIG. 1 bore selector, in a retracted position, according to a further embodiment; and, FIG. 13*b* is a front perspective view of the FIG. 13*a* rams in an extended position.

FIG. 1 shows a bore selector apparatus 100 comprising a universal bore selector 10, a toolstring crossover 70 and a choice of a triple bore spacer sub 80 and a dual-bore sub 90.

The bore selector apparatus 100 is provided at the top of a well and connects a monobore riser system (not shown) above, with a multi-bore well (not shown) below. As described in more detail below, the bore selector device 10 can direct rams, arranged perpendicularly to the main bore of the apparatus 100, in order to direct a toolstring lowered through the riser into a selected bore of the well.

An advantage of certain embodiments is that they have a ram valve style configuration where ram blocks are displaced by a set of linear pistons, aligned coaxially, and mounted opposite from each other to operate in a direction perpendicular and towards the well bore. This style of mechanism offers a reduction in dynamic components and improves the robustness over alternative mechanisms due to the nature of the simplified and reduced component load paths. The linear pistons, perpendicular to the well bore, offer the ability for the operator to exert control of ram positions in tandem or independently, offering multiple configurations in which to position the rams for running tools. This provides the operational variety to support selecting of the multiple bore sizes and spacings of subsea systems.

A further advantage of certain embodiments is that the bore selector device 10 is more adaptable for different wells, indeed it can be universal. Project-specific adapters can be attached, such as a bespoke crossover 70 and one of the bore spacer subs 80, 90 shown in FIG. 1 (optionally including a circulation attachment 81, 91). This can offer significant cost and inventory reduction.

The bore selector device 10 is shown in more details in FIGS. 2*a* and 2*b* comprising a housing 11 with a bore 20 extending therethrough. Piston actuators 13 are mounted opposite each other and drive respective rams 12 linearly in the direction perpendicular to that of the bore 20. The bore 20 beneath the rams is a single bore only.

Thus, in use, the movement of the pistons 13 actuates movement of the ram blocks 12 in the same direction, between retracted and extended positions, details of which are described later. The pistons 13 may be moved independently from one another and, consequently, each of the rams 12 may be actuated to move independently of the other.

The rams 12 each comprise a downwardly tapered portion 14 such as, when both rams are in the extended position, a guide portion is formed having the shape of a funnel, as shown in FIG. 2*b*. In use, when a tool is run through the bore selector device 10, it is guided down the funnel towards a desired bore of the well.

The end sections of the bore selector device 10 each feature a generic flange connection 18, 19 to interface with multiple system crossovers which are then interfaced to the system specific tree running tool or an emergency disconnect package (EDP).

In this example, the height H of the bore selector is 37.5 inches (95.3 cm).

Figure 3A:
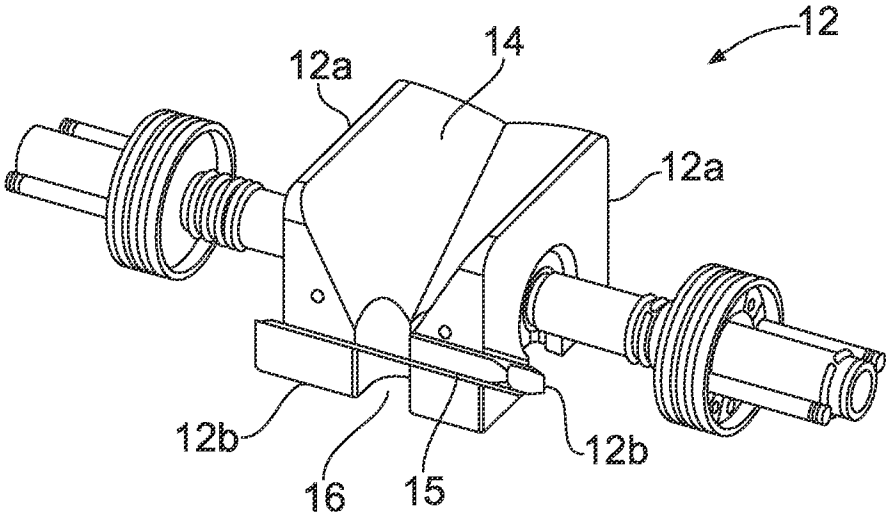
Figure 3B:
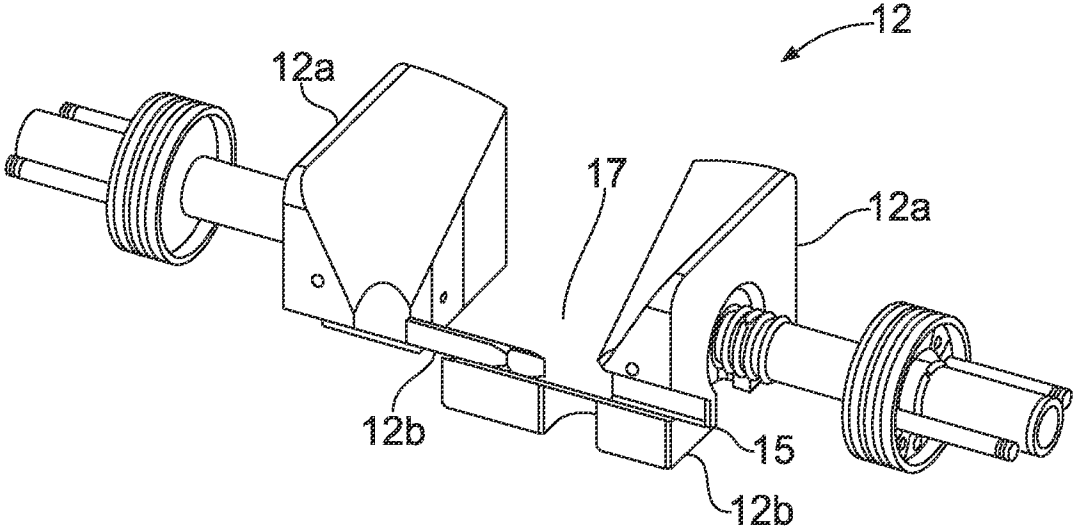

FIGS. 3*a* and 3*b* show the rams 12 in more detail, in extended and retracted position, respectively. Each ram 12 of the bore selector device 10 comprises a primary ram element 12*a* and a secondary ram element 12*b*.

The primary ram elements 12*a* each comprise the tapered portion 14 which form the funnel when in extended position, as shown in FIG. 3*a*. The secondary rams 12*b* in the form of tongues each protrude from the primary rams 12*a*, towards the bottom of the tapered portion 14. One of the rams 12 defines a groove 15 therein shaped to receive the secondary ram element 12*b* of the other ram 12 when in the extended position. One secondary ram 12*b* defines an opening therein which aligns with an opening in one primary ram 12*a*, forming a passage 16 through the rams 12 when in extended position. Thus, the bore 20 of the bore selector 10 is not fully blocked when in the extended position. In use, when in the extended position, access to a production bore of the well is prevented by the barrier formed by the primary ram elements 12*a*, while access to an annulus bore of the well is permitted by the passage 16.

When the rams 12 are in the retracted position, the primary ram elements 12*a* are retracted as shown in FIG. 3*b*, forming a passage 17 through the bore selector 10. The secondary ram elements 12*b* partially overlap, thereby blocking part of the bore 20 of the bore selector 10 and closing the passage 16 (formed in the extended position).

Thus, the bore 20 of the bore selector 10 is still partially blocked when in the retracted position. In use, when in the retracted position, access to a production bore is allowed through the passage 17, while access to an annulus bore is prevented by the barrier formed by the secondary ram elements 12*b*.

An advantage of certain embodiments is that the independent movement of the rams 12 allows for multiple ram configurations. This allows for multiple paths for running tools through the bore selector device 10.

The ram positions for each configuration are shown in FIGS. 4*a*-4*d* displaying how access is obtained for different modes in dual and triple bore systems. The figures show cross-sectional views through the bore 20 of the bore selector device 10, which in turn is connected to a dual or triple bore system such as the bore spacer subs 80, 90, shown in FIG. 1. The same bore selector device may be used for access of either of the dual and triple systems.

Figure 4A:
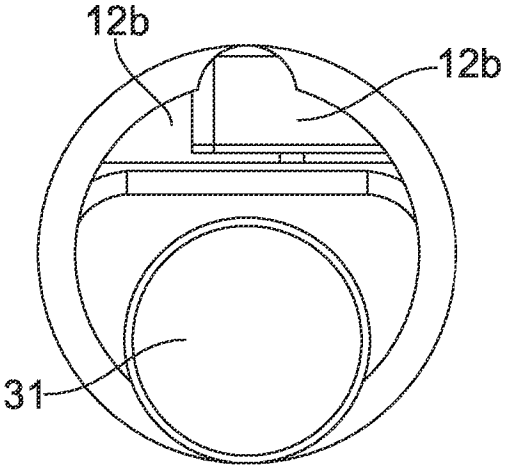
Figure 4B:
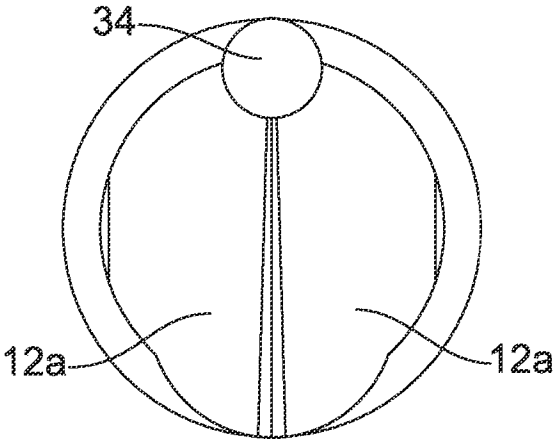

Ram positions suitable for obtaining access in a dual bore system are shown in FIGS. 4*a* and 4*b*. The well comprises a production bore 31 and an annulus bore 34. In FIG. 4*a* both rams 12 are in an retracted position, with the production bore 31 open and the annulus bore 34 blocked by secondary ram elements 12*b*. FIG. 4*b* shows the extended position of rams 12 with the primary ram elements 12*a* blocking the production bore 31, and with the annulus bore 34 open.

Figure 4C:
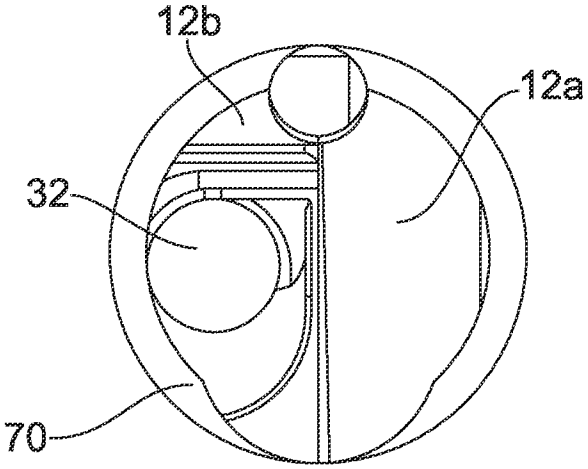
Figure 4D:
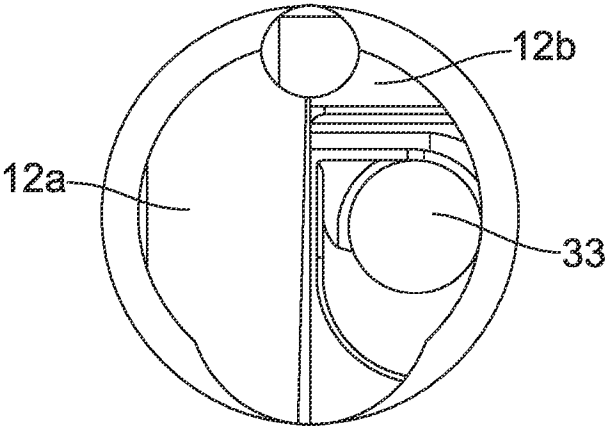

Ram positions suitable for obtaining access to a triple bore system are shown in FIGS. 4*b* & 4*d* where the well comprises a primary production bore 32, a secondary production bore 33 and an annulus bore 34. The configuration in FIG. 4*b* is common to the dual and triple systems, both rams 12 in an extended position, thereby allowing access to the annulus bore 34 only. While in the dual bore system, rams in the extended configuration block the sole production bore 31, in the triple bore system both production bores 32 and 33 are blocked.

In FIG. 4*c* only one of the rams 12 is in the extended position, thereby blocking the first production bore 32 only, and the secondary ram element 12*b* of the ram 12 in the retracted position blocks the annulus bore 34. FIG. 4*d* shows an opposite configuration to that of FIG. 4*c*, with the secondary production bore 33 open and the first production bore 31 and the annulus bore 34 blocked.

Figure 5B:
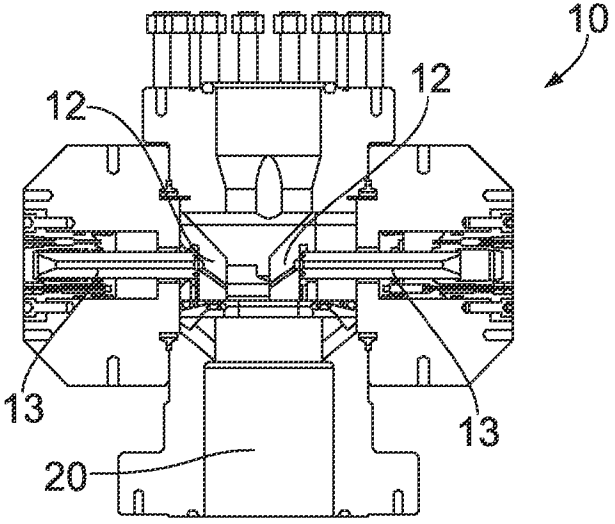
Figure 5C:
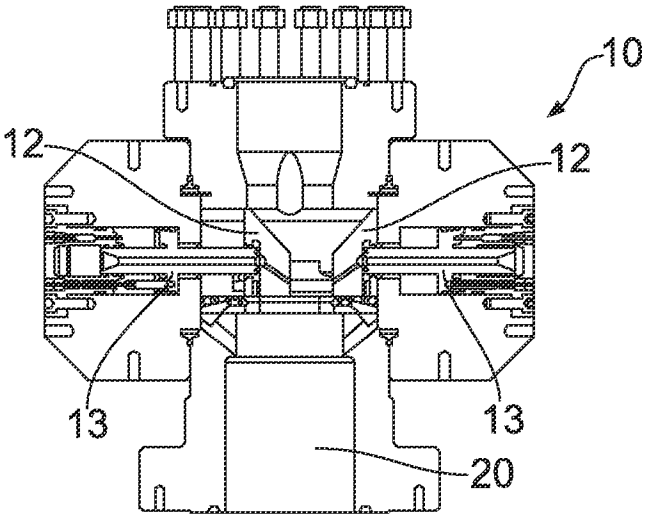
Figure 5A:
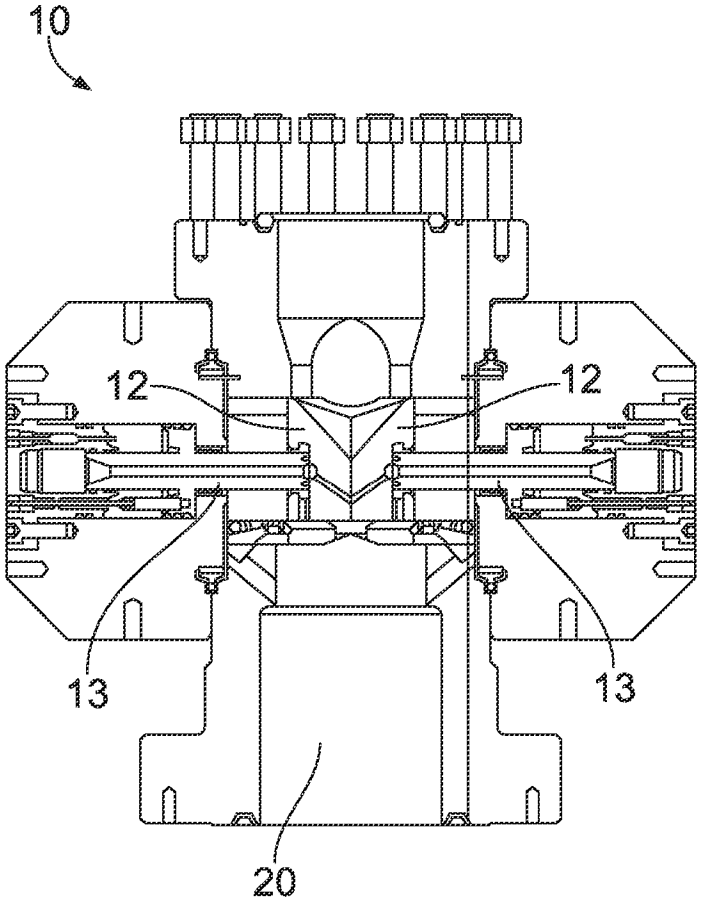

FIGS. 5*a*-5*c* show the bore selector device 10 with rams 12 in different configurations. In FIG. 5*a* both rams 12 are in the extended position of FIG. 4*b*. FIGS. 5*b* and 5*c* show the bore selector 10 with rams 12 in configurations of FIGS. 4*c* and 4*d*, respectively.

Figure 6:
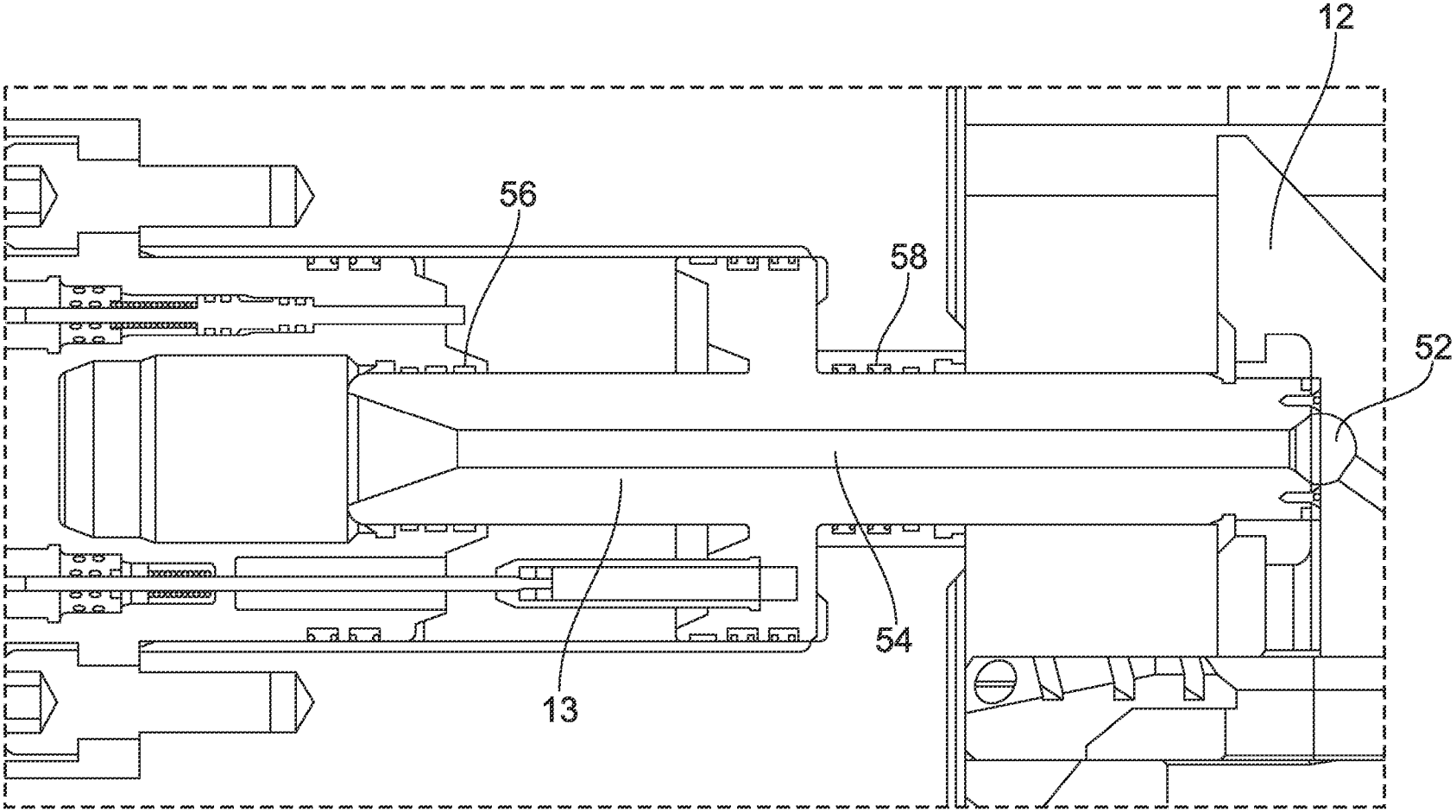
FIG. 6 is a close front sectional view of a piston of the FIG. 1 bore selector device.

FIG. 6 shows a piston 13 of the bore selector device 10. The piston is pressure balanced by allowing bore pressure to also enter a chamber 52 at the back of the pistons 13 through porting 54. Seals 56, 58 on either side of the piston 13 have equal seal diameters therefore pressure-balancing the piston 13 ensuring the actuator is not influenced by applied bore pressure.

Figure 7:
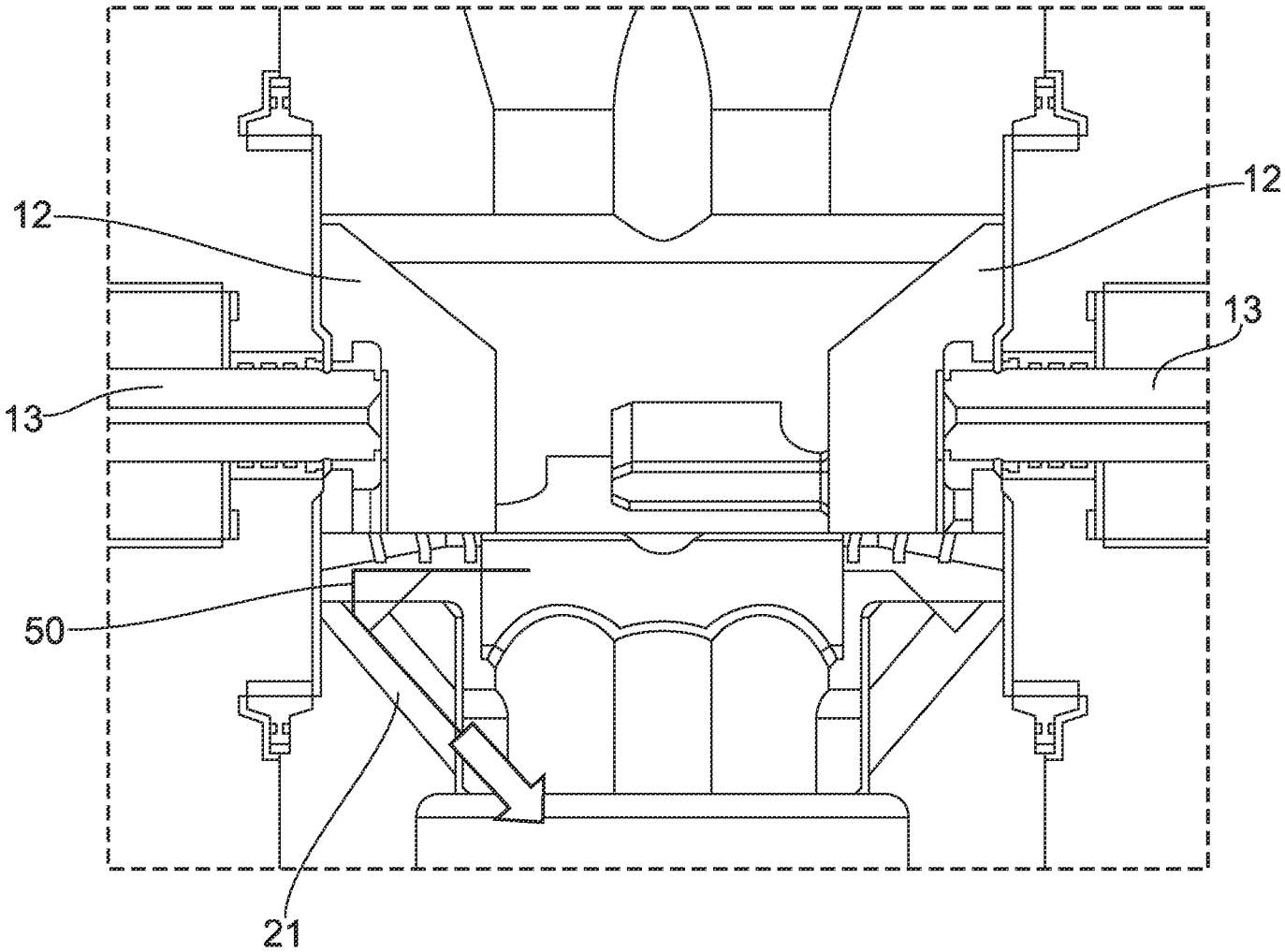
FIG. 7 is a front sectional view of the FIG. 2*a*/2*b* bore selector device showing a debris flow path.

FIG. 7 shows the bore selector 10 in an retracted position with channels 21 beneath the rams 12 leading to the bore. A further advantage of certain embodiments is that debris flow paths 50 ensure that when the rams 12 are retracted there cannot be packing off behind the rams 12 as they drag debris into the channels 21.

FIGS. 8*a*-8*c* & 9*a*-9*c* show tooling 60 being passed through the bore selector device 10. In FIGS. 8*a*-8*c* an open spang jar is manoeuvred into an annulus bore through the bore selector 10. In FIGS. 9*a*-9*c*, a nest tool is manoeuvred into a production bore through the same bore selector device 10.

FIGS. 10*a*-10*b* & 11*a*-11*b* show the bore selector device 10 mounted onto bore spacer subs 80, 90 (tree running tool adapter) in triple and dual configuration, respectively. The bore spacer subs 80, 90 each define discrete bores in order to align with the different bores of the well below and help maintain alignment of the tools to the directed bore, beneath the rams 12. The bore spacer subs 80, 90 each include a projection 93 which extends into the bore 20 of the bore selector device 10. An insert 92 is fitted on top of the projection 93 of the bore spacer sub 80, 90. The insert 92 allows for a smoother transition between the bore selector device 10 and the bore spacer sub 80, 90.

Thus, the dual bore spacer sub 90 provides two discrete bores towards the production bore 931 and annulus bore 934 of the well, as shown in FIG. 10*b*. Other configurations of three or more multiple bores is possible. For example, the triple bore spacer sub 80 provides discrete bores for two production bores (not shown in section of FIG. 11*a*) and the annulus bore 834.

The optional circulation attachments 91, 81 provide circulation return lines back to surface. The subs 80, 90 and circulation attachments 81, 91 can be configured with plug profiles or valves to enable isolation of either bore, to suit operational requirements (e.g. well circulation, cementing, etc).

A further embodiment of the invention is to be reconfigured for shearing. This could be achieved through changeout of the bore selector ram bodies 12 for shear rams whilst maintaining the common housing block and pistons 13. Bore selection and shearing functionality may be combined.

FIGS. 12*a*-12*b* and 13*a*-13*b* show rams 112 of an embodiment of the bore selector device 10 with similar features to the above embodiments, and also including blades for shearing cables or the like.

Primary ram elements 112*a* of the bore selector device 110 comprises a shear blade 140 with a cutting edge 141. The shear blades 140, are positioned in off-set locations with respect to one another, defining an upper blade 140*a* and a lower blade 140*b*, and respective upper and lower blade cutting edges 141*a*, 141*b*. When the rams 112 are in the extended position, the upper and lower blade cutting edges 141*a*, 141*b* overlap, thus ensuring complete alignment of the rams 112, as shown in FIG. 12*b*. Thus, with both rams 112 in the extended position, the cable is sheared by the action of the cutting edges 141 of the shearing blades 140.

The shearing blades 140 may be formed as part of rams 112 or as separate components, attached to the rams 112 and fastened into place, for example via screws. In isolation, the upper and lower blades 140*a*, 140*b* are designed as identical parts. When attached to/formed as part of the rams 112, the upper and lower blades 140*a* 140*b* are orientated upside down with respect to one another, such that the cutting edges 141*a*, 141*b* align when the rams 112 are in the extended position.

As shown in the embodiment of FIGS. 12*a*-12*b*, the shear blades 140 are centred around a production bore. Some embodiments of the bore selector device 110 may incorporate shearing inserts centred on an annulus bore, instead of or as well as the shear blades centred around a production bore.

FIGS. 13*a*-13*b* illustrate rams 112 of an embodiment of the bore selector device 110 comprising shearing blades 140 as part of the primary ram elements 112*b*, thus centred around a production bore, as well as shearing inserts with cutting edges 142 fitted to the secondary ram elements 112*b*, thus centred around an annulus bore. In the embodiment of FIGS. 13*a*-13*b*, the cutting edges 142 are between the guiding seat and the secondary ram element 112*b*.

Thus, some embodiments of the present invention may have the advantage of allowing for sheering of, for example, a cable run therethrough The bore selector 10 could be positioned above a dual bore EDP or landed directly onto a dual (or triple) bore tree with the necessary well barriers above. In the latter application, through use of the circulation loop below the bore selector 10 and by adding in the required well barriers above, coupled with a system disconnect mechanism (e.g. a latch or break-away joint type arrangement) a lighter weight system can be configured for, for example, P&A work.

Thus, a further advantage of certain embodiments is that the height and weight of the bore selector 10 can be kept to a minimum, for example by integrating the circulation system beneath the bore selector 10 and with the adaptor designed to suit the required bore spacings. This is particularly advantageous for applications where a system needs to land on an older, potentially fatigued, wellhead; where use of a traditional EDP/LRP arrangement may be an issue.

Improvements may be made without departing from the scope of the invention. For example, the particular wellbore selected in the extended and retracted positions respectively may swapped around compared to the illustrated embodiment.

The invention claimed is:

1. A bore selector device for use with a multi-bore subsea equipment having a first bore and a second bore, the bore selector device comprising:

a housing defining a bore extending therethrough the bore having a main longitudinal axis;

at least a first and a second actuator opposite each other, each moveable between respective retracted and extended positions in a direction perpendicular to the main longitudinal axis;

each actuator connected to a respective ram such that the rams are each moveable between respective retracted positions and extended positions within the bore and in a direction perpendicular to the main longitudinal axis to direct tooling being passed through the bore toward either the first bore or the second bore of the multi-bore subsea equipment;

wherein each actuator and attached ram is moveable in the same linear direction, wherein the bore selector device comprises a maximum of a single bore between the rams and a lower flange connector adapted to connect to a bore spacer sub having at least two discrete bores.

2. A bore selector device as claimed in claim 1, wherein each ram comprises a primary ram portion and a secondary ram portion connected to the primary ram portion, the secondary portions extending from the respective primary portions towards the opposite actuator.

3. A bore selector device as claimed in claim 2, wherein at least one secondary portion is a tongue.

4. A bore selector device as claimed in claim 3, wherein a groove is provided in at least one of the primary portions, into which the tongue of the opposite ram engages when in the extended position.

5. A bore selector device as claimed in claim 2, wherein at least one primary ram portion comprises a portion sloping in a first downwards direction.

6. A bore selector device as claimed in claim 2, wherein in the extended position, the primary ram portions abut.

7. A bore selector device as claimed in claim 2, wherein in the extended position, the primary ram portions together form a funnel.

8. A bore selector device as claimed in claim 2, wherein at least one secondary ram portion can comprise a portion sloping in a second downwards direction.

9. A bore selector device as claimed in claim 2, wherein in the retracted position, at least one secondary portion is positioned in the bore.

10. A bore selector device as claimed in claim 2, wherein at least one primary portion defines a through-passage towards a first downwards direction.

11. A bore selector device as claimed in claim 2, wherein at least one secondary portion defines a through-passage towards a first downwards direction.

12. A bore selector device as claimed in claim 11, wherein in the extended position, the through-passage of the primary and secondary portions align and wherein at least one primary portion defines a through-passage towards the first downwards direction.

13. A bore selector device as claimed in claim 1, wherein actuators and associated rams are independently moveable such that one actuator and associated ram is moveable to the extended position whilst the other actuator and ram is positioned in the retracted position.

14. A bore selector device as claimed in claim 1, wherein opposite ends of each actuator are exposed to bore pressure, thus pressure balancing the actuators.

15. A bore selector device as claimed in claim 1, wherein the bore selector device is less than 2 m in height.

16. A bore selector device as claimed in claim 1, wherein the outside diameter of the bore selector is less than 2m.

17. A bore selector device as claimed in claim 1, wherein at least one downwardly sloping channel is provided in the housing below the ram in the retracted position and leading to a bore therebelow.

18. A bore selector device as claimed in claim 1, wherein the bore selector device comprises an upper connector, opposite the lower flange connector.

19. A bore selector device as claimed in claim 1, wherein the rams include a shearing blade or are shaped with an integrated shearing edge.

20. A bore selector device as claimed in claim 1, wherein the single bore is at least 7" (17.8 cm) in diameter.

21. A bore selector apparatus comprising the bore selector device as claimed in claim 1, connected to at least one of an attachment and the bore spacer sub.

22. A bore selector apparatus as claimed in claim 21, wherein, the single bore of the bore selector device is the same diameter, or greater, than the diameter of the attachment, and wherein the single bore is at least 7" (17.8 cm) in diameter.

23. A bore selector apparatus as claimed in claim 21, the bore-spacer sub includes a projection which extends into the bore of the bore selector device when connected thereto.

24. A bore selector apparatus as claimed in claim 23, wherein the projection defines the at least two discrete bores.

25. A bore selector apparatus as claimed in claim 21, wherein the attachment is a tool-string cross-over.

26. A bore selector apparatus as claimed in claim 21, wherein the apparatus comprises a circulating attachment connected to the bore-spacer sub.

27. Use of a bore selector apparatus as claimed in claim 21 to connect a mono bore riser to a multi-bore subsea equipment by attaching the lower flange connector of the bore selector apparatus to the bore spacer sub having at least two discrete bores, the bore spacer sub being connected to the multi-bore subsea equipment, and attaching the mono bore riser to an upper connector, opposite the lower flange connector.

* * * * *